US006065387A

United States Patent [19]

Blair

[11] Patent Number: 6,065,387

[45] Date of Patent: May 23, 2000

[54] PISTON APPARATUS FOR GAS/LIQUID PIPELINE

[76] Inventor: Jim S. Blair, P.O. Box 208, Morrin, Alberta, Canada, T0J 2B0

[21] Appl. No.: 09/123,311

[22] Filed: Jul. 28, 1998

[51] Int. Cl.[7] ..... F01L 15/12

[52] U.S. Cl. ..... 91/224; 91/229

[58] Field of Search ..... 91/224, 229

[56] References Cited

U.S. PATENT DOCUMENTS

| | | | |
|---|---|---|---|
| Re. 34,301 | 7/1993 | Brooks . | |
| 916,463 | 3/1909 | Lewis . | |
| 1,058,718 | 4/1913 | Brigger . | |
| 1,129,362 | 2/1915 | Ryder . | |
| 1,164,926 | 12/1915 | Clark . | |
| 1,569,183 | 1/1926 | Herman et al. . | |
| 2,147,150 | 2/1939 | Conklin et al. . | |
| 2,191,399 | 2/1940 | Chenault . | |
| 2,408,075 | 9/1946 | Kowalski et al. | 91/224 |
| 2,544,094 | 3/1951 | Knowles . | |
| 2,603,191 | 7/1952 | Sterrett . | |
| 3,193,026 | 7/1965 | Kupka . | |
| 3,233,628 | 2/1966 | Hammelmann | 91/229 |
| 4,096,747 | 6/1978 | Gilson | 91/224 |
| 4,141,215 | 2/1979 | Cadalzo . | |
| 4,165,759 | 8/1979 | Tucker | 91/224 |
| 4,458,579 | 7/1984 | Rasmussen | 91/224 |

*Primary Examiner*—F. Daniel Lopez

*Attorney, Agent, or Firm*—Thomas E Malyszko

[57] ABSTRACT

A reciprocating fluid driven motor apparatus is provided for operating within a pipeline system carrying fluid under pressure to harness some of the energy stored in the pressurized fluid and convert it into mechanical motion for performing other desired tasks. The apparatus includes a barrel having an inlet in fluid communication with an upstream portion of the pipeline and an outlet in fluid communication with a downstream portion of the pipeline, and a differential pressure regulator in a by-pass portion of the pipeline connecting the upstream and downstream portions to create a greater pressure in the upstream portion than the downstream portion. A piston slides reciprocally within the barrel in a fluid tight manner. The piston has an interior cavity for allowing fluid movement therethrough, and a cyclically operable closure member for opening and closing the fluid movement through the piston. The piston is moved upwardly within the barrel by the pressurized fluid beneath the piston to an upper limit of travel upon closing the closure member, and the piston is allowed to fall by force of gravity from the upper limit of travel to a lower limit of travel upon opening the closure member to allow the fluid beneath the piston to travel through the interior cavity and into the barrel's outlet for discharge into the downstream portion of the pipeline. A piston rod extends from the piston and slidably through the barrel for transferring movement of the piston to the exterior of the barrel to perform a desired task. The entire system is closed so that no fluid leaves the apparatus but merely continues to travel along the pipeline.

20 Claims, 4 Drawing Sheets

PISTON APPARATUS FOR GAS/LIQUID PIPELINE

FIELD OF THE INVENTION

The present invention relates to a piston system and apparatus for harnessing energy from a pressurized fluid flowing in a pipeline.

BACKGROUND OF THE INVENTION

Fluids flowing through a pipeline are typically under pressure to provide motive energy to the fluid. A fluid, namely liquid or gas, which is under pressure from natural sources, such as oil or natural gas from an underground reservoir or well, may be harnessed in whole or part to perform other functions or tasks. At wellsites in the oil and gas industry, for instance, energy is often needed to operate pumps for a variety of purposes, including glycol dehydration, methanol injection, heat tracing of liquid lines, chemical injection, instrumentation, and the like.

At remote wellsites where delivery of electricity is not feasible from an existing power grid, the associated pumps must be operated by other means. Typically, at natural gas wellsites, a portion of the gas from the well's main gas stream is diverted for running the pumps. A significant drawback of these existing arrangements is that the gas is vented to atmosphere as exhaust after being used in the pumps. There appears to be no practical and economical means of recovering such vented gas, particularly since the exhaust is at a significantly lower pressure than that of the gas pipeline. Hence, wellsites operators are faced with the undesireable result of having raw gas emissions to atmosphere, which is believed to be detrimental to the environment, as well as losing the opportunity to sell the vented gas.

What is desired therefore is a novel system and apparatus which overcomes the limitations and problems of prior art pump arrangements. Preferably it should provide a fairly simple and compact device with few moving parts for efficiently and automatically harnessing energy from a pressurized fluid stream in a pipeline to perform a desired task. The system should be fully self contained in that any fluid diverted from the main fluid stream is returned to that fluid stream without any venting to atmosphere. The harnessed energy may be transferred elsewhere mechanically, such as by a movable piston rod, to perform work such as pumping or compressing other fluids, or by other suitable means such as electrical transfer.

SUMMARY OF THE INVENTION

The invention provides a reciprocating fluid driven apparatus for a pipeline system carrying said fluid under pressure, said apparatus comprising:

a hollow elongate barrel having a top end, an opposed bottom end with an inlet in fluid communication with an upstream portion of said pipeline, and an outlet located intermediate said top and bottom ends in fluid communication with said pipeline downstream of said upstream portion;

a piston located within the barrel for reciprocal sliding therein in a relatively fluid tight manner, said piston having opposed upper and lower ends, an interior cavity for allowing fluid movement therethrough between said upper and lower ends, a through hole in said lower end for fluid communication between said hollow interior cavity and said barrel beneath the piston, at least one opening in said upper end of the piston for fluid communication between said interior cavity and the barrel above the piston, and a cyclically operable closure member for opening and closing said through hole, said piston being moved upwardly within said barrel by said pressurized fluid beneath said piston to an upper limit of travel upon said closure member closing said through hole, and said piston being allowed to fall by force of gravity from said upper limit of travel to a lower limit of travel upon said closure member opening said through hole to allow said fluid beneath the piston to travel through said interior cavity and into said outlet of the barrel for discharge into said downstream portion of the pipeline; and a piston rod extending from said upper end of the piston and sidably through said top end of the barrel in a relatively fluid tight manner for transferring movement of the piston to the exterior of the barrel.

DESCRIPTION OF THE DRAWINGS

Embodiments of the invention will now be described, by way of example only, with reference to the accompanying drawings, wherein.

LIST OF REFERENCE NUMBERS IN DRAWINGS

Figure 1:
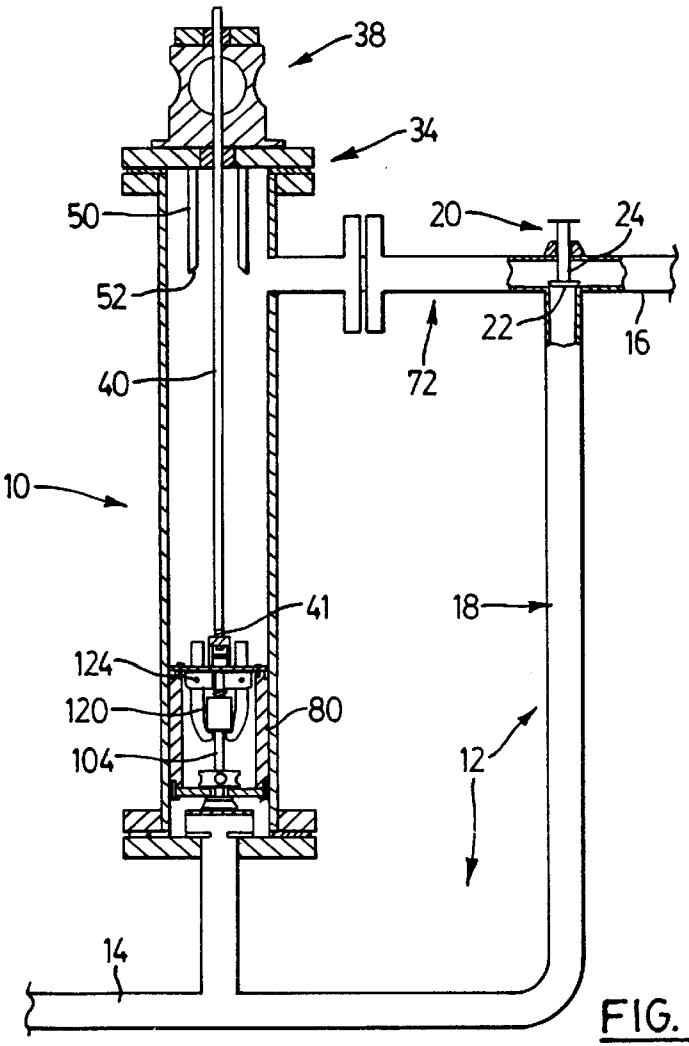
FIG. 1 is an elevated cross-sectional view of a piston apparatus according to a first embodiment of the present invention, with the piston at its lower limit of travel, mounted to a pipeline for carrying pressurized fluid.

10 piston apparatus
12 pipeline
14 upstream portion of 12
16 downstream portion of 12
18 by-pass of 12
20 differential pressure regulator
22 check valve
24 spring
30 barrel
32 inner surface of 30
33 inner cavity of 30
34 top end of 30
36 bottom end of 30
38 head piece for 30
40 piston rod
41 threaded end of 40
42*a*/*b* packing
44 bolts and nuts
46 top flange of 30
48 gasket
50 contact cone
52 sloped edge of 50
54 end piece
56 bottom flange of 30
58 bolts and nuts

60 gasket
62 inlet of 30
64 inlet tube
66 valve strike member
68 valve strike surface of 66
70 outlet of 30
72 outlet pipe
80 piston
82 body of 80
84 chamber of 80
86 outer surface of 80
88 bands on 86
90 seal on 86
92 groove for 90
94 upper plate of 80
95 apertures in 94
96 lower plate of 80
98 perimeter bolts
100 keeper for 40
102 threaded hole of 100
104 valve rod in 80
106 through hole in 96
108 sleeve for 104
110 lower guide for 104
112 cap member on 104
114 annular seal on 112
116 ports in 110
118 spring
120 cup
122 levers
124 hinge
126 bridge member of 94
127 slits in 126
128 top end of 122
130 seat on 122
132 washer and retainer bolt for 104
180 piston (second embodiment)
182 spring
184 rests for 182

DESCRIPTION OF PREFERRED EMBODIMENTS

Figure 2:
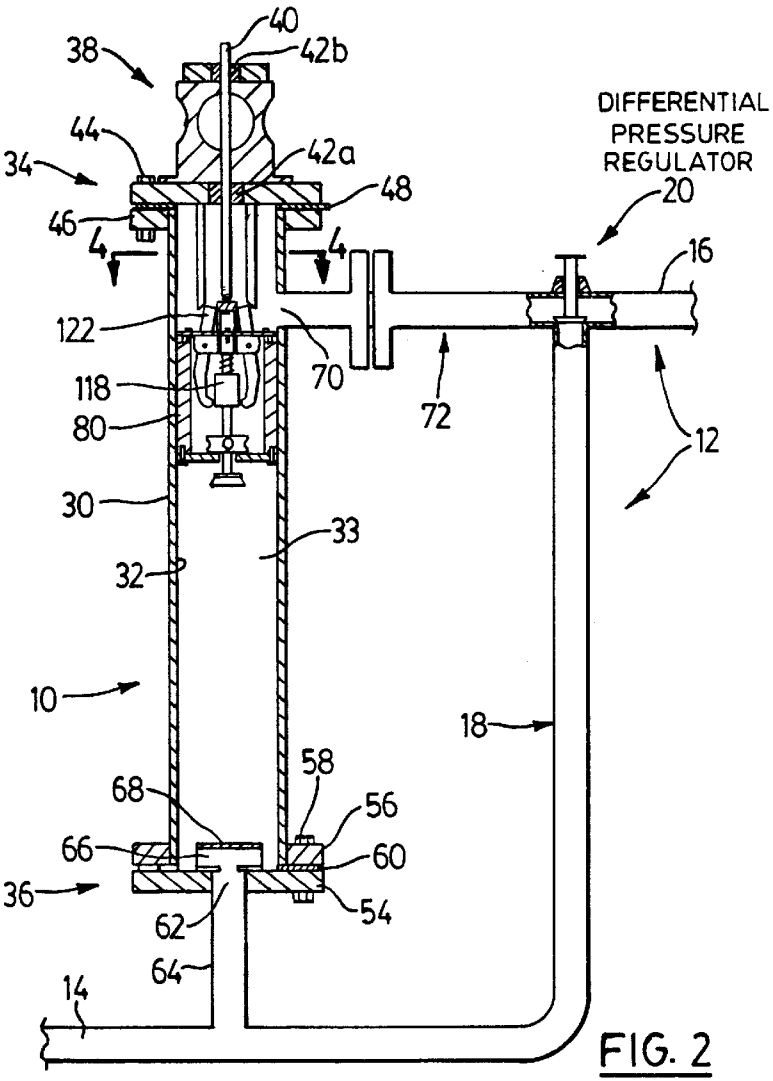
FIG. 2 is a view similar to FIG. 1 showing the piston at its upper limit of travel.

A reciprocating fluid driven apparatus of the present invention, generally designated by reference numeral 10 in FIGS. 1 and 2, is mounted to a pipeline 12 carrying fluid under pressure. The apparatus 10 is also referred to herein as a motor or engine since it harnesses some of the energy stored in the pressurized fluid and converts the harnessed energy into mechanical motion, which mechanical motion is imparted to another device to perform other desired tasks and purposes, such as those noted earlier. The fluid may be any transportable liquid or gas capable of flowing through a pipeline under low or high pressures. For illustrative purposes the pipeline 12 may be considered one that handles natural gas from a natural gas wellhead which may have a pressure of several psi to several hundred psi.

The pipeline has an upstream portion 14, a downstream portion 16, and a by-pass portion 18 therebetween. At least some of the gas from the upstream portion 14 will flow into the motor apparatus 10 and then exit the apparatus into the downstream portion 16. Hence, none of this "diverted" gas is discharged into the atmosphere but remains within the pipeline system for further use. A differential pressure regulator 20 located in the by-pass 18 controls or maintains a differential pressure drop across the regulator, namely a greater pressure in the upstream position 14 than in the downstream portion 16, for operating the motor apparatus 10. The regulator 20 is preferably a manually or automatically controlled valve which opens to allow gas flow from the by-pass 18 to the downstream portion 16 upon the build up of a pre-set pressure differential between the by-pass 18 and downstream portions. Good results have been achieved using a check valve 22 with a spring 24 having a compression value of 2 to 5 pounds (i.e. the valve opens if the force of the differential pressure in the by-pass reaches the spring's compression value). The check valve 22 is adjustable to vary the differential pressure, thereby controlling the stroking rate of the motor's piston 80 and the amount of energy transferred or harnessed by the motor.

Figure 4:
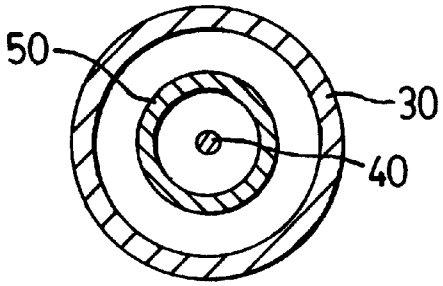
FIG. 4 is a sectional view along line 4—4 in FIG. 2.

An important aspect of the invention is the construction and operation of the motor apparatus 10. The apparatus has a main outer body, namely a hollow elongate barrel 30, slidably housing the piston 80 therein. The barrel 30 has a generally smooth cylindrical inner surface 32 forming an inner cavity 33 for accommodating the piston 80. The barrel 30 is mounted onto the pipeline 12 generally vertically to allow the force of gravity to pull the piston 80 on a downward stroke as noted below. The top end 34 of the barrel 30 is capped by a head piece 38 through which a piston or polish rod 40 extends into the barrel. Packing is provided at 42*a* and 42*b* to seal about the rod to avoid gas escaping from the cavity 33 to the ambient, and to laterally support the rod 40 as it slides through the head 38 in upward and downward strokes, respectively. The head 38 is connected onto a top flange 46 of the barrel by a circumferentially spaced arrangement of nuts and bolts 44 or equivalent fasteners, and an annular gasket 48 is provided therebetween for sealing purposes. A hollow cylindrical contact cone 50, shown in cross-section in FIG. 4, is fixed to the underside of the head 38 and extends downwardly into the cavity 33, terminating with an inwardly sloped circumferential edge 52 for contacting the piston 80, as described later. The rod 40 passes freely through the hollow center of the cone 50. In the embodiment shown the cone's edge 52 should form a continuous circular surface to ensure contact with the piston 80, and in particular with a pair of levers 122 extending above the piston, should the piston rotate within the barrel 30.

The opposed bottom end 36 of the barrel 30 is capped by an end piece 54 which is connected to a bottom flange 56 of the barrel by a circumferentially spaced arrangement of nuts and bolts 58 or like fasteners, and a gasket 60 is provided for sealing purposes as at the top end. The end piece 54 has a central opening forming a inlet 62 for gas to enter the inner cavity 33 from an inlet tube 64 communicating with the upstream portion 14 of the pipeline 12. Above the inlet 62 a valve strike member 66 is located within the cavity 33 and has a top valve strike surface 68 for engaging a bottom of the piston 80 to prevent the piston from blocking the inlet 62 during its downward stroke and from blocking entry of gas into the barrel's cavity 33. The strike member 66 has at least one inner passage for the gas to pass from the inlet 62 to the inner cavity 33. Although the strike surface 68 is flat in the preferred embodiment shown, it will be appreciated that a domed surface or other shapes may be used as well.

An outlet 70 opens into the side of the barrel 30 spaced below the barrel's top end 34. The outlet 70 has a sealed connection to an outlet pipe 72 extending to the differential pressure regulator 20 and communicating with the downstream portion 16 of the pipeline for expelling gas from the barrel 30 back into the pipeline 12. The opening of the outlet 70 into the barrel 30 is located across from the terminal edge 52 of the cone 50 to prevent the piston 80 from blocking the outlet at the upper limit of its travel, as noted below. Hence, in the embodiment shown, the outlet 70 may be located elsewhere closer to the top end 34 of the barrel, but not any lower than shown in FIG. 1 to avoid the above-noted blockage. The outlet 70 may also be provided through the head piece 38, although this is not preferred due to extra machining costs.

Figure 3:
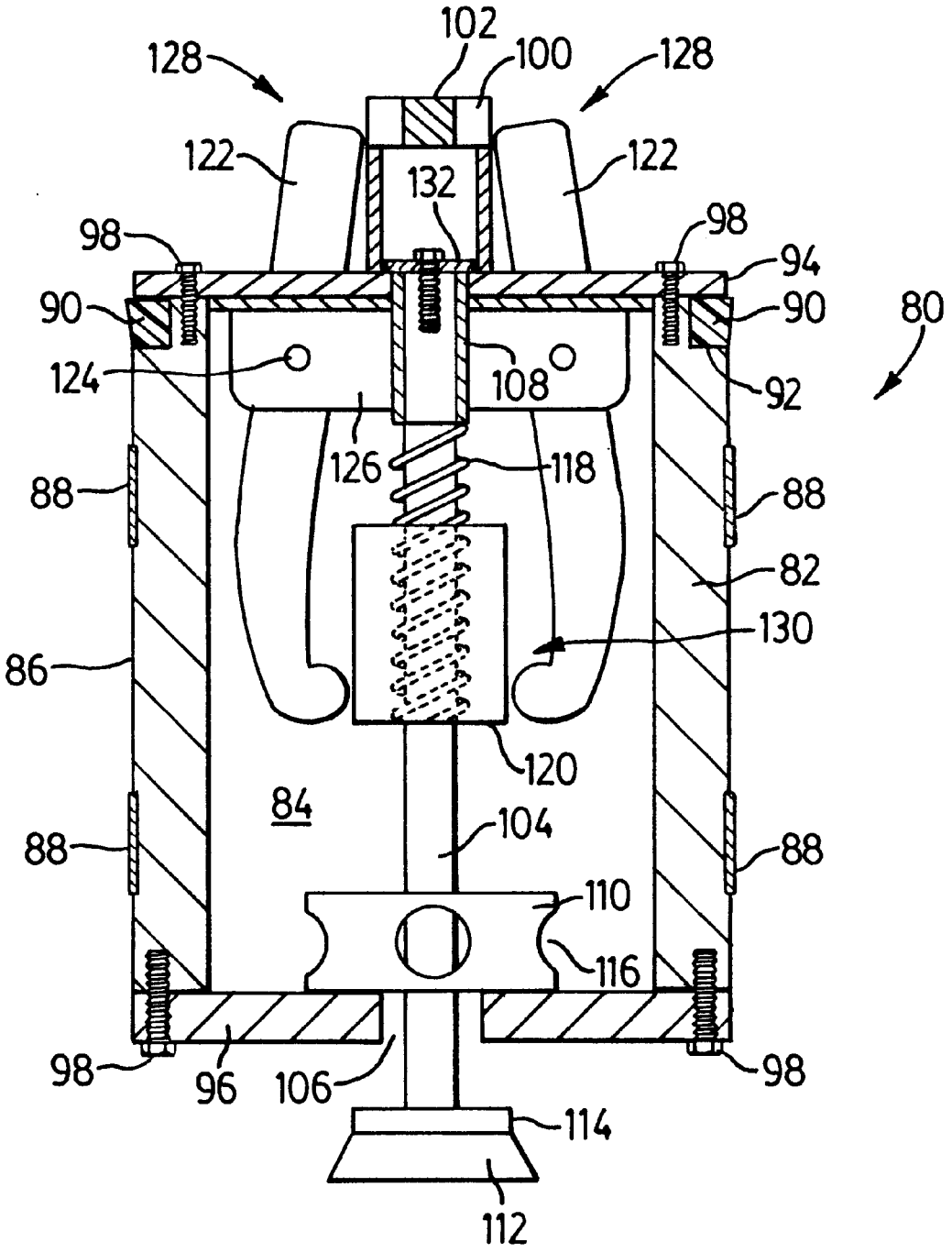
FIG. 3 is close-up view of the piston shown in FIGS. 1 & 2.
Figure 5:
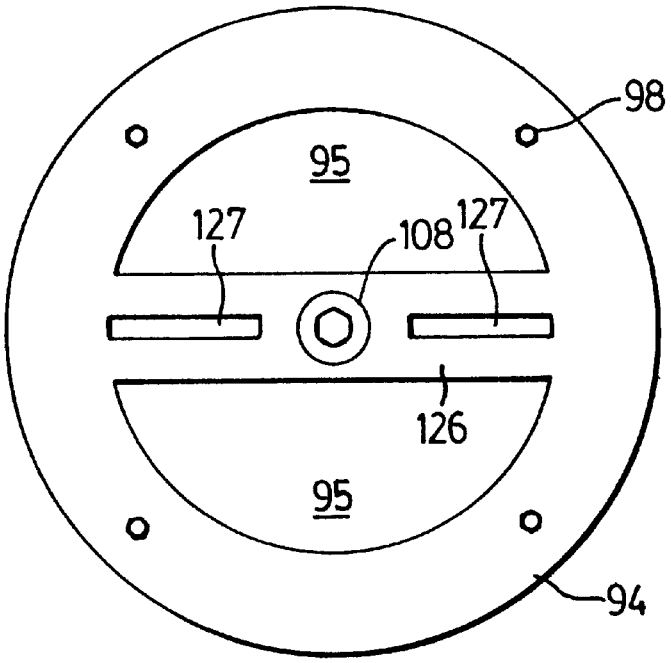
FIG. 5 is a top view of an upper circular plate of the piston in FIG. 3.

Referring now to FIGS. 3 in particular, the piston 80 has a hollow cylindrical body 82 defining an interior cavity or chamber 84 and a generally cylindrical outer surface 86 contoured to closely fit and slidingly engage the inner cavity 33. Circumferential bands 88 made of TEFLON or other like low-function material are fixed about the piston's outer surface 86 to reduce sliding friction of the piston within the barrel 30. A fluid impermeable ring seal 90 is also seated within a circumferential groove 92 at the upper end of the piston to provide a fluid-tight seal between the piston and barrel. The upper and lower ends of the piston body 82 are capped with circular plates 94 and 96, respectively, and secured thereto by perimeter bolts 98. A pair of apertures 95 in the upper plate 94 (see FIG. 5) allow for fluid communication between the piston's chamber 84 and the barrel's interior cavity 33 above the piston 80. A hollow keeper 100 is fixed atop a bridge member 126 of the upper plate 94 and has a threaded hole 102 for securing a correspondingly threaded terminal end 41 of the piston rod 40 thereto. The piston rod 40 therefore suspends the piston within the barrel and moves reciprocally therewith.

A movable valve rod 104 is centrally located along a longitudinal axis of the piston 80 for opening and closing in a fluid tight manner a single central opening or through hole 106 in the lower plate 96, which hole allows for fluid communication between the piston's chamber 84 and the barrel's interior cavity 33 beneath the piston 80. The top portion of the rod 104 slides within a hollow open-ended sleeve 108 fixed to the bridge member 126 of the upper plate 94. The top end of the rod 104 is capped by a circular washer 132 bolted thereto and capable of sliding within the keeper 100 in unison with the valve rod 104. The washer 132 is radially larger than the inside of the sleeve 108 to stop downward movement of the valve rod 104 and to retain the rod's top portion within the sleeve. Good results have been had using a valve rod with an outer diameter of 0.5 inch (about 12.7 mm) and a sleeve with an inner diameter of 0.5 inch, within acceptable tolerances to accommodate the above noted sliding. A lower guide 110 atop the through hole 106 has nylon bushings for guiding and laterally supporting the rod 104 near its bottom end. At its bottom end the rod 104 has a cap member 112 and an annular seal 114 of larger diameter than the through hole 106 for closing (i.e. fluidly sealing) the hole 106 when the rod slides up and the seal 114 engages the lower plate 96 (i.e. a 'closed position" as seen in FIG. 1). When in the open position (as in FIGS. 2&3), the seal 114 is spaced away from the hole 106 to allow fluid to pass through the hole 106 and a series of side ports 116 in the lower guide 110. The valve rod 104 is urged downwardly into the open position by a biaser in the form of a compressed spring 118 wound about the rod 104. At one end the spring 118 bears against the sleeve 108 and at the other end sits within a hollow cup shaped spring stop 120, referred to herein as a "cup", having an open top and a closed bottom, which bottom is integral with or secured by other means to the valve rod 104.

Figure 3A:
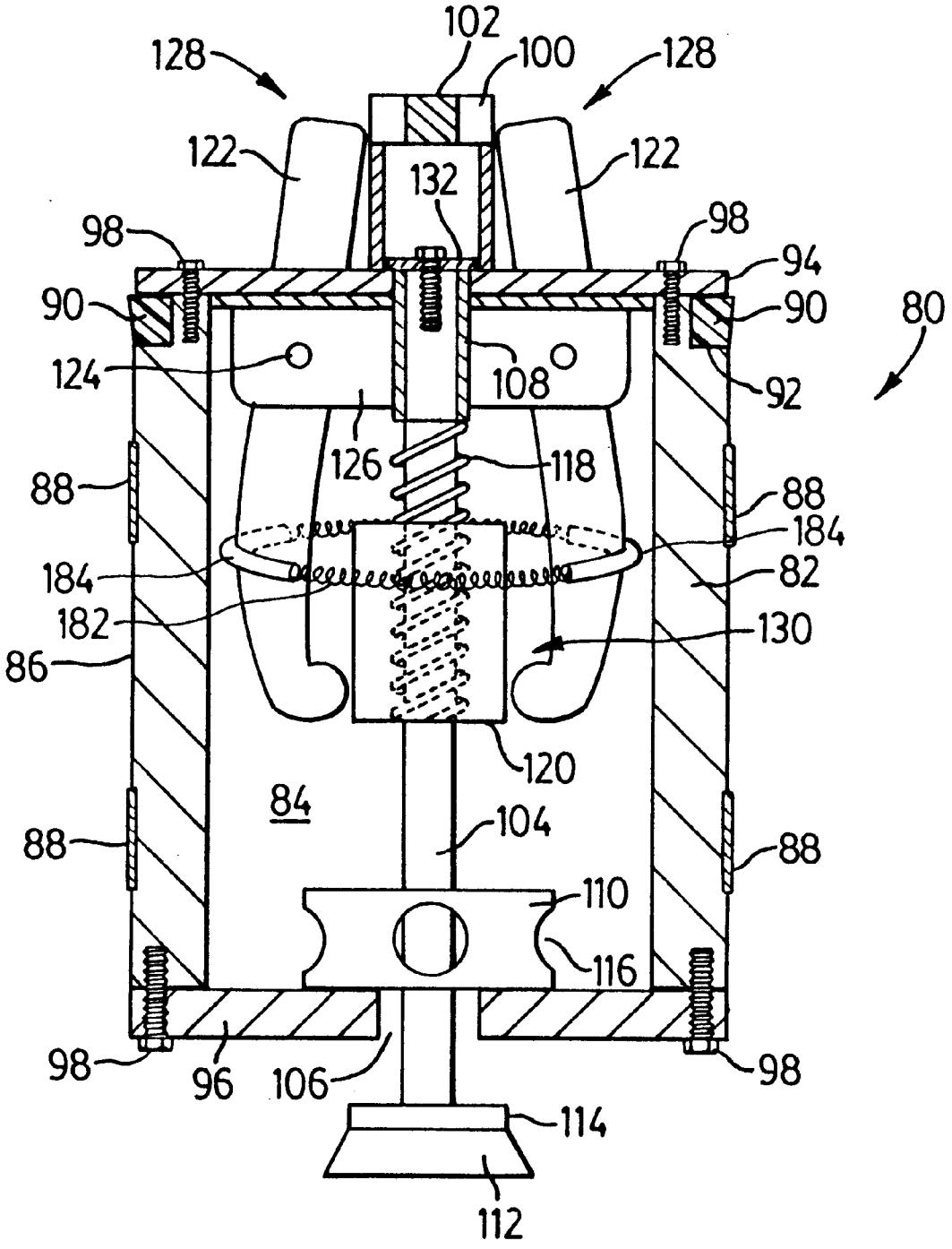
FIG. 3*a* is a view similar to FIG. 3 showing a second embodiment of the piston in which the levers are biased inwardly by a closed loop spring.

The piston 80 has a locking mechanism for positively locking the rod 104 in its closed position when the piston moves down to its lower limit of travel within the barrel 30 (FIG. 1). A principle component of the locking mechanism is an arrangement of elongate levers 122 which extend through corresponding slits 127 (see FIG. 5) in the upper plate's bridge member 126. In the preferred embodiment there are two radially opposed levers 122, each of which is pivotally supported at hinge 124 on the bridge member 126. A top end 128 of each lever 122 extends above the upper plate 94 for contacting the cone 50 at the piston's upper limit of travel (FIG. 2). A bottom end of each lever 122 has an inwardly extending portion 130 forming a seat capable of engaging and holding the bottom of cup 120 at the piston's lower limit of travel as shown in FIG. 1. In the FIG. 3 embodiment the levers 122 may optionally be biased inwardly at hinges 124 for urging the lever seats 130 toward the valve rod 104 to securely catch and hold the cup 120. In an alternate embodiment of the piston 180 shown in FIG. 3*a*, where the same reference numerals are used for the same of substantially similar components, a spring 182 encircles the levers 122 below the hinges 124 to urge them inwardly. The spring 182 is positioned about the levers by semi-circular rests 184 welded onto the levers 122.

The operation and advantages of the motor apparatus 10 may now be better appreciated. Starting with the piston 80 approaching the bottom of the barrel 30 on a downward stroke, the valve rod 104 is in an extended or open position (as in FIG. 3) which allows gas beneath the piston to flow through the piston, namely in a path through the through hole 106, the ports 116, the chamber 84 and out the apertures 95 in the upper plate 94, and to then continue through the outlet 70 to the downstream portion 16 of the pipeline. In the piston's open position the spring 118 keeps the valve rod cup 120 in a lowered position between the lower seat portions 130 of the levers 122. The piston 80 continues falling by force of gravity to the bottom of the barrel 30 and eventually the cap 112 of the piston's valve rod 104 engages the valve strike surface 68 atop the valve strike member 66. The piston 80 continues its downward motion by force of gravity and counteracts the downward force of the spring 118 on the valve rod cup 120 until the seal 114 engages the piston's lower plate 96 and seals the through hole 106, at which point the piston 80 has reached its lower limit of travel (as in FIG. 1). The seat portions 130 of the levers 122 may now pivot about their respective hinges 124 beneath the cup 120 to positively lock the valve rod 104 in its closed position (as in FIG. 1). As a result, gas is unable to flow through or around the piston.

At the piston's lower limit of travel, gas flowing through the upstream portion 14 of the pipeline enters the barrel 30 through inlet 62, and gas pressure begins to build under the closed piston 80 due to the pre-set resistance of the differential pressure regulator 20 on the by-pass piping 18. Once a sufficient pressure is reached to lift the piston 80 and the piston rod 40, the piston slides toward the top of the barrel 30 and moves the piston rod 40 in an upward stroke. The piston's upper limit of travel is reached when the top ends 128 of the levers 122 engage the contact cone 50. The cone's sloped edge 52 releases the cup 120 by urging the levers'top ends 128 inwardly and swinging the lower seat ends 130 from beneath the cup 120. The spring 118 forces the cup 120 and the entire valve rod 104 away from the upper plate 94 into an open position (as in FIG. 2), allowing the built-up pressure beneath the piston to escape through the piston and out the outlet 70. Hence, the piston 80 should not obstruct the barrels outlet 70 when at its upper limit of travel (FIG. 2). With the pressure generally equalized below and above the open piston, the piston falls by gravity toward the bottom of the barrel and pulls the piston rod 40 in a downward stroke. The gas continues to pass through the piston 80 during the downward stroke until the piston is once again closed at its lower limit of travel for another cycle. The speed of the piston's travel, and therefore the frequency of each cycle, may be varied by adjusting the setting on the differential pressure regulator 20.

It should now be appreciated that work is accomplished by the piston of the present invention outside of the pressurized gas pipeline system by mechanically transferring energy out of the system via the piston rod. The motor apparatus is environmentally friendly in that energy is harnessed from the naturally pressurized gas without releasing the gas to atmosphere, through burning or otherwise. Good results have been achieved using an apparatus 10 with the following components: a 40.0 inch long barrel with a 6.0 inch inside diameter; a 7.0 inch long piston with an outside diameter of 6.0 inches; a piston rod with a 0.5 inch outside diameter; and piping of approximately 2.0 inch outer diameter.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below. For instance, the piston rod may be operatively connected to an electrical generating device, which electricity may be used elsewhere as required, rather than by mere mechanical transfer of energy. Also, the barrel may be set in an inclined position if need be, although this is not preferred to maximize the force of gravity on downward strokes and to avoid uneven wear on one side of the barrels inner surface 32.

I claim:

1. A reciprocating fluid driven apparatus for a pipeline system carrying said fluid under pressure, said apparatus comprising:

a hollow elongate barrel having a top end, an opposed bottom end with an inlet in fluid communication with an upstream portion of said pipeline, and an outlet located above said bottom end in fluid communication with said pipeline downstream of said upstream portion;

a piston located within the barrel for reciprocal sliding therein in a relatively fluid tight manner, said piston having opposed upper and lower ends, an interior cavity for allowing fluid movement therethrough between said upper and lower ends, a through hole in said lower end for fluid communication between said hollow interior cavity and said barrel beneath the piston, at least one opening in said upper end of the piston for fluid communication between said interior cavity and the barrel above the piston, and a cyclically operable closure member for opening and closing said through hole, said piston being moved upwardly within said barrel by said pressurized fluid beneath said piston to an upper limit of travel upon said closure member closing said through hole, and said piston being allowed to fall by force of gravity from said upper limit of travel to a lower limit of travel upon said closure member opening said through hole to allow said fluid beneath the piston to travel through said interior cavity and into said outlet of the barrel for discharge into said downstream portion of the pipeline;

said piston including a locking mechanism for positively locking said closure member upon closing said through hole at said lower limit of travel, said locking mechanism including an arrangement of levers at said upper end of the piston wherein a bottom end of each lever is located within said interior cavity of the piston and a top end of each lever extends out of and above said upper end of the piston, each of said levers being pivotable about a point intermediate said bottom and top ends so that said bottom end of each lever is aligned with said closure member for movement to lock and unlock said closure member; and a piston rod extending from said upper end of the piston and slidably through said top end of the barrel in a relatively fluid tight manner for transferring movement of the piston to the exterior of the barrel.

2. The apparatus of claim 1 wherein said top end of the barrel includes a release member for unlocking said closure member upon said piston reaching said upper limit of travel to allow said closure member to open said through hole.

3. The apparatus of claim 2 wherein said release member comprises a tubular contact cone extending downwardly into the barrel from said top end, said contact cone having a hollow interior to allow said piston rod to extend therethrough.

4. The apparatus of claim 2 wherein said bottom end of the barrel includes a valve strike member for engaging said closure member to close said through hole by force of gravity upon said piston reaching said lower limit of travel.

5. The apparatus of claim 4 wherein said valve strike member is located over said inlet at the bottom end of the barrel, said strike member having a bore with at least one lateral opening for fluid communication from said inlet into said hollow barrel, and a strike surface elevated from said bottom end of the barrel for engaging said closure member of the piston.

6. The apparatus of claim 1 wherein said piston includes a biasing member for urging said closure member to open said through hole.

7. The apparatus of claim 6 wherein said biasing member comprises a stop operatively connected to said closure member, and a biaser extending from said stop to said upper end of the piston for pushing said closure member in a direction from said upper to lower ends of the piston.

8. The apparatus of claim 7 wherein said piston includes a biaser for urging said biasing member into an extended position upon said piston reaching said upper limit of travel to keep said bottom ends of the levers in an outwardly extended position so that said closure member keeps said through hole opened until said lower limit of travel is reached, at which point said closure member moves the biasing member toward the upper end of the piston to allow said bottom ends of the levers to pivot beneath the biasing member for positively locking said closure member.

9. The apparatus of claim 8 wherein a second biaser urges said bottom ends of the levers toward said closure member and beneath said biasing member.

10. The apparatus of claim 1 wherein said outlet of the barrel is located intermediate said top end of the barrel and said piston at the upper limit of travel.

11. The apparatus of claim 1 further including a by-pass portion in fluid communication between said upstream portion of the pipeline and said pipeline downstream of said barrel to allow for periodic flow of fluid past said barrel.

12. The apparatus of claim 11 wherein a differential pressure regulator in said by-pass portion creates a greater pressure in the fluid at said upstream portion of the pipeline upon said closure member closing said through hole.

13. The apparatus of claim 12 wherein said differential pressure regulator is adjustable to vary said pressure in the fluid at said upstream portion of the pipeline to control the stroking rate of said reciprocal sliding piston and the amount of energy harnessed from said fluid.

14. A reciprocating fluid driven apparatus for a pipeline system carrying said fluid under pressure, said apparatus comprising:

a hollow elongate barrel having a top end, an opposed bottom end with an inlet in fluid communication with an upstream portion of said pipeline, and an outlet located above said bottom end in fluid communication with said pipeline downstream of said upstream portion;

a piston located within the barrel for reciprocal sliding therein in a relatively fluid tight manner, said piston having opposed upper and lower ends, an interior cavity for allowing fluid movement therethrough between said upper and lower ends, a through hole in said lower end for fluid communication between said hollow interior cavity and said barrel beneath the piston, at least one opening in said upper end of the piston for fluid communication between said interior cavity and the barrel above the piston, and a cyclically operable closure member for opening and closing said through hole, said piston being moved upwardly within said barrel by said pressurized fluid beneath said piston to an upper limit of travel upon said closure member closing said through hole, and said piston being allowed to fall by force of gravity from said upper limit of travel to a lower limit of travel upon said closure member opening said through hole to allow said fluid beneath the piston to travel through said interior cavity and into said outlet of the barrel for discharge into said downstream portion of the pipeline, wherein said piston includes a locking mechanism for positively locking said closure member upon closing said through hole at said lower limit of travel;

said top end of the barrel including a release member for unlocking said closure member upon said piston reaching said upper limit of travel to allow said closure member to open said through hole, said release member comprising a tubular contact cone extending downwardly into the barrel from said top end, said contact cone having a hollow interior to allow said piston rod to extend therethrough; and, a piston rod extending from said upper end of the piston and slidably through said top end of the barrel in a relatively fluid tight manner for transferring movement of the piston to the exterior of the barrel.

15. The apparatus of claim 14 wherein said bottom end of the barrel includes a valve strike member for engaging said closure member to close said through hole by force of gravity upon said piston reaching said lower limit of travel.

16. The apparatus of claim 15 wherein said valve strike member is located over said inlet at the bottom end of the barrel, said strike member having a bore with at least one lateral opening for fluid communication from said inlet into said hollow barrel, and a strike surface elevated from said bottom end of the barrel for engaging said closure member of the piston.

17. The apparatus of claim 14 wherein said locking mechanism includes an arrangement of levers at said upper end of the piston wherein a bottom end of each lever is located within said interior cavity of the piston and a top end of each lever extends out of and above said upper end of the piston, each of said levers being pivotable about a point intermediate said bottom and top ends so that said bottom end of each lever is aligned with said closure member for movement to lock and unlock said closure member.

18. A reciprocating fluid driven apparatus for a pipeline system carrying said fluid under pressure, said apparatus comprising:

a hollow elongate barrel having a top end, an opposed bottom end with an inlet in fluid communication with an upstream portion of said pipeline, and an outlet located above said bottom end in fluid communication with said pipeline downstream of said upstream portion;

a piston located within the barrel for reciprocal sliding therein in a relatively fluid tight manner, said piston having opposed upper and lower ends, an interior cavity for allowing fluid movement therethrough between said upper and lower ends, a through hole in said lower end for fluid communication between said hollow interior cavity and said barrel beneath the piston, at least one opening in said upper end of the piston for fluid communication between said interior cavity and the barrel above the piston, and a cyclically operable closure member for opening and closing said through hole, said piston being moved upwardly within said barrel by said pressurized fluid beneath said piston to an upper limit of travel upon said closure member closing said through hole, and said piston being allowed to fall by force of gravity from said upper limit of travel to a lower limit of travel upon said closure member opening said through hole to allow said fluid beneath the piston to travel through said interior cavity and into said outlet of the barrel for discharge into said downstream portion of the pipeline;

a piston rod extending from said upper end of the piston and slidably through said top end of the barrel in a relatively fluid tight manner for transferring movement of the piston to the exterior of the barrel;

wherein said bottom end of the barrel includes a valve strike member for engaging said closure member to close said through hole by force of gravity upon said piston reaching said lower limit of travel, said valve strike member being located over said inlet at the bottom end of the barrel, said strike member having a bore with at least one lateral opening for fluid communication from said inlet into said hollow barrel, and a strike surface elevated from said bottom end of the barrel for engaging said closure member of the piston.

19. The apparatus of claim 18 wherein said top end of the barrel includes a release member for unlocking said closure member upon said piston reaching said upper limit of travel to allow said closure member to open said through hole, said release member comprising a tubular contact cone extending downwardly into the barrel from said top end, said contact cone having a hollow interior to allow said piston rod to extend therethrough.

20. The apparatus of claim 18 wherein said piston includes a locking mechanism for positively locking said closure member upon closing said through hole at said lower limit of travel, said locking mechanism including an arrangement of levers at said upper end of the piston wherein a bottom end of each lever is located within said interior cavity of the piston and a top end of each lever extends out of and above said upper end of the piston, each of said levers being pivotable about a point intermediate said bottom and top ends so that said bottom end of each lever is aligned with said closure member for movement to lock and unlock said closure member.

* * * * *